US005472106A

United States Patent [19]

Nofer

[11] Patent Number: 5,472,106

[45] Date of Patent: Dec. 5, 1995

[54] TAMPER RESISTANT CLOSURE CAP AND A METHOD OF OPERATION THEREFOR

[75] Inventor: Karl H. Nofer, Kitchener, Canada

[73] Assignee: Pano Cap (Canada) Limited, Kitchener, Canada

[21] Appl. No.: 152,127

[22] Filed: Nov. 16, 1993

Related U.S. Application Data

[63] Continuation-in-part of Ser. No. 794,043, Nov. 19, 1991, abandoned.

[30] Foreign Application Priority Data

Nov. 8, 1991 [CA] Canada ..... 2055210

[51] Int. Cl.[6] ..... B65D 41/34

[52] U.S. Cl. ..... 215/256; 215/321

[58] Field of Search ..... 215/252, 256, 215/321, 329, 344, 330, 254; 220/288

[56] References Cited

U.S. PATENT DOCUMENTS

| | | | |
|---|---|---|---|
| 4,199,071 | 4/1980 | D'Amico | 215/256 |
| 4,342,400 | 8/1982 | Llera | 215/256 |
| 4,417,666 | 11/1983 | Roberts | 215/256 |
| 4,449,639 | 5/1984 | Davis | 215/224 |
| 4,470,513 | 9/1984 | Ostrowsky | 215/252 |
| 4,478,343 | 10/1984 | Ostrowsky | 215/252 |
| 4,597,500 | 7/1986 | Stubbs | 215/256 |
| 4,732,289 | 3/1988 | Granat et al. | 215/252 |
| 4,848,614 | 7/1989 | Csaszar | 215/252 |
| 4,905,852 | 3/1990 | Zumbuhl | 215/270 |
| 4,984,701 | 1/1991 | Margaria | 215/256 |

*Primary Examiner*—Stephen P. Garbe
*Attorney, Agent, or Firm*—Daryl W. Schnurr

[57] ABSTRACT

A tamper resistant closure and a method of installing and removing that closure relative to a container where the container has a neck with external threads thereon and a ring located beneath the threads. The closure has a central portion with a periphery and a skirt extending from the periphery, a tear strip extending from the skirt, a tamper evident band extending from the tear strip and a movable flange extending from the band. The tear strip is affixed between the skirt and the band by a plurality of severable tabs. The flange is hinged to the tamper evident band and has equally spaced windows in it to make it flexible so that it can be stretched over the ring. When the closure is installed on the container, the flange is forced against an interior of the band and overrides the ring. Once the flange has overridden the ring, a free edge of the flange moves inward to rest against an outer surface of the neck beneath the ring. The closure can then not be removed from the container without first severing the tabs as the flange will not override the ring during removal of the closure. When the tear strip is removed, there is a relatively large gap between the skirt and the band, making it readily apparent that the contents of the container may have been tampered with. Once the tear strip has been removed, the closure functions in a conventional manner for opening and closing the container. The screw thread on the closure is made up of elongated bubbles located end to end.

20 Claims, 7 Drawing Sheets

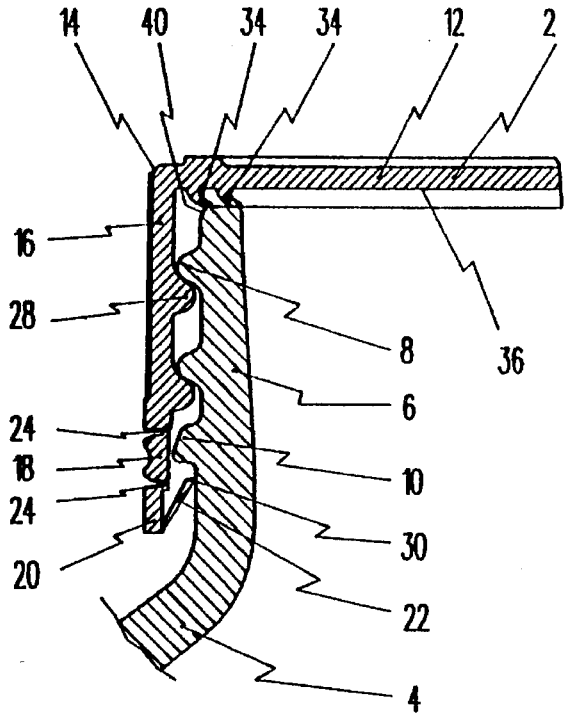
FIGURE 4
FIGURE 5
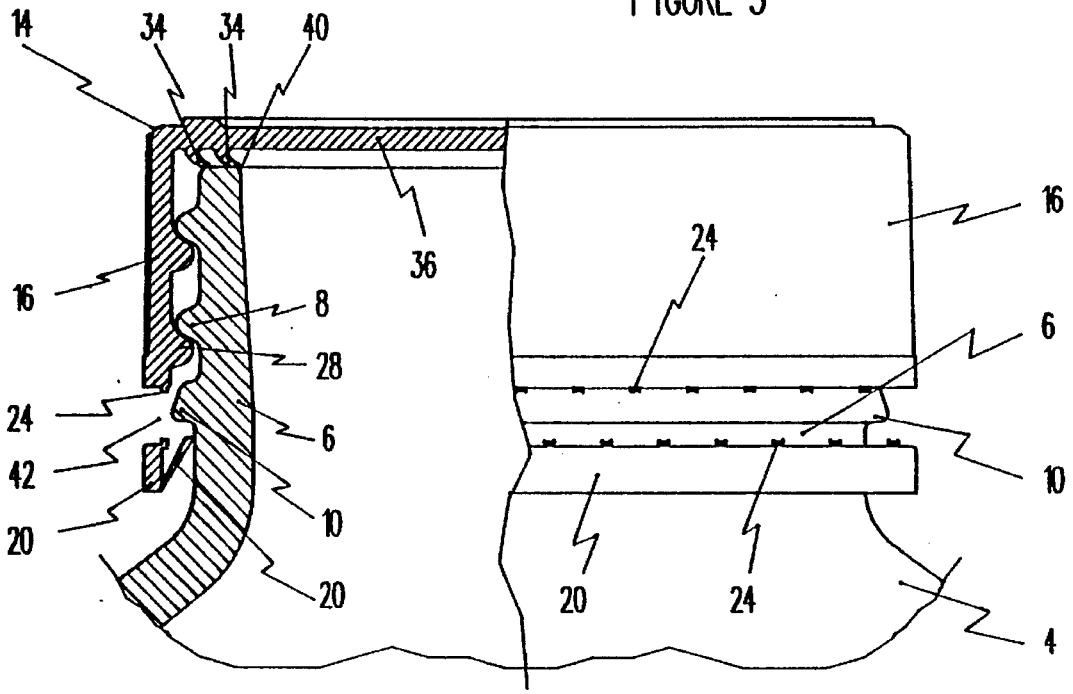

TAMPER RESISTANT CLOSURE CAP AND A METHOD OF OPERATION THEREFOR

This is a continuation-in-part application of application Ser. No. 07/794,043 filed Nov. 19, 1991 now abandoned.

BACKGROUND OF THE INVENTION

1. Field of the Invention

This invention relates to a tamper resistant closure for use on a container and, in particular, to a tamper resistant closure containing a tear strip in combination with a tamper evident band containing a flange that is hinged to said band.

2. Description of the Prior Art

For safety and security reasons, tamper resistant closures are known. One such previous closure is described in European Patent Application Number 90310078.2 published on Apr. 10th, 1991. The closure in that Application has a tamper evident band having a movable flange thereon with the band being connected to the closure along a weakened line. The weakened line can be formed by scoring or by circumferentially-spaced bridges. When the closure is installed on the container, the flange and tamper evident band override a ring on the container. When the closure is desired to be removed, sufficient force must be exerted on the closure to sever the tamper evident band and flange from the rest of the closure along the weakened line. A disadvantage of this closure is that the weakened line must be designed within a very fine tolerance, one that is not always satisfactorily achieved during manufacture. If the weakened line is not made sufficiently strong, the band and flange will sever from the rest of the closure during the initial installation of the closure on the filled container or during shipping and handling. When this occurs, the packaging process of the manufacturer is greatly disrupted, often resulting in the product located within the container being discarded. If the weakened line is strong enough so that it is not severed during the initial installation or during subsequent shipping and handling, the weakened line is often too strong to be readily opened by the ultimate consumer without the use of tools or other aids. Also, when the tamper evident portion is separated from the remainder of a closure along a weakened line, it is possible to remove the closure, tamper with the contents of the container and replace the closure. A consumer who does not subject the closure and container to close inspection, may not notice that the weakened line has been severed until after the purchase has been completed and an attempt is made to open the container for the first time. Further, as closures are often tightly turned onto the containers, a consumer may not even notice that the weakened line has been severed when they open the container for the first time.

PCT application Ser. No. US 91/05434 published on Mar. 5, 1992 describes a tamper indicating closure having a retaining hoop with relief windows extending from a hinged edge at least one-third of the distance toward a free edge. The windows are located to interrupt the hinged edge and create a series of spaced hinges around the circumference of the closure. The windows are located along the hinged edge so that the retainer can be moved from an outward molded position to an inward installation position much more easily so that the retainer does not have to be moved between the two positions by a separate step. With the present invention, the windows are spaced from the hinged edge. In Canadian Patent No. 1,182,782 issued on Feb. 19th, 1985, there is described a closure and container with screw threads made up of a series of projections in the shape of truncated cones so that the screw threads of the closure and container can interlock with one another. The projections were made by drilling successive holes into a core for use in a mold. The separate drilling of each hole can be extremely time consuming particularly when the spacing between holes and the depth of each hole must be identical.

SUMMARY OF THE INVENTION

It is an object of the present invention to provide a tamper resistant closure having a tear strip in combination with a flange hinged onto a tamper evident band, said closure providing clear visual evidence of tampering and providing relatively wide tolerances for manufacture.

A tamper resistant closure is used on a container having a neck surrounding an opening said neck having external threads thereon, said neck having a ring located beneath said threads when the container is in an upright position. The closure has a central portion having a periphery with a skirt extending from said periphery, a tear strip extending from said skirt, a tamper evident band affixed to said tear strip and a movable flange extending from said band. The tear strip is affixed to said skirt by a plurality of severable attachment means. The skirt has an interior surface with threads thereon corresponding to the threads on said container. The flange is connected to said band by hinging means so that said flange extends inwardly relative to said band and a free edge of said flange is movable between an upper position and a lower position. The central portion, skirt, strip, band and flange are sized to fit snugly on said neck so that when the threads of the neck are engaged with the threads of the closure, the closure is in a closed position relative to said container. The free edge of said flange is located above said hinging means and beneath said ring. The flange overrides said ring as the closure is installed on said container. The flange engages said ring when the closure is attempted to be removed from said container to prevent said flange from overriding said ring, said band and flange being detachable from said skirt by severing said attachment means to remove said tear strip.

A method of installing and removing a tamper resistant closure relative to a container is used where the container has a neck surrounding an opening with the neck having external threads thereon and a ring located beneath said threads when the container is in an upright position. The closure has a central portion with a periphery and a skirt extending from said periphery, a tear strip extending from said skirt, a tamper evident band extending from said tear strip and a movable flange extending from said band. The tear strip is affixed between said skirt and said band by severable attachment means. The skirt has an interior surface with threads thereon corresponding to threads on the container. The flange is connected to said band by hinging means so that the flange extends inwardly relative to said band and a free edge of said flange is movable between an upper position and a lower position. The method comprises installing said closure on said container so that said flange overrides said ring and is located beneath said ring when the closure is in a closed position relative to said container. The free edge of said flange is located above said hinging means and beneath said ring. Subsequently, when it is desired to remove said closure from said container, grasping one end of said tear strip and manually pulling it to sever the attachment means and to remove the tear strip from said closure. Then, removing said closure from said container, the band and flange remaining on said container.

A method of manufacturing a core of a mold to form screw threads made up of elongated bubbles located end to end, said core having a cylindrically-shaped outer surface thereon, said method using a ring-shaped electrode having a cylindrically-shaped inner surface thereon, said electrode being sized to fit over said cylindrically-shaped outer surface of said core, with equally-spaced contact points on said inner surface, said electrode being connected to a high voltage source and mounted in an electrical discharge machine, there being a contact point on said inner surface for each bubble to be formed in said screw thread, contacting one contact point of said electrode for every two vertically spaced bubble-shaped depressions that are to be cut into said core, said method comprising moving the electrode such that one contact point contacts said outer surface at a time to burn at least one bubble into said outer surface, moving the electrode so that a second contact edge cuts at least one more bubble into said outer surface, repeating this process until each contact point around the circumference of the electrode contacts an outer surface of said core to burn oblong bubble shapes into said core so that said bubble shapes form a screw thread around said core from end to end, each contact edge cutting two vertically aligned bubbles where parts of the screw therads are to be vertically spaced from one another.

BRIEF DESCRIPTION OF THE DRAWINGS

In the drawings:

FIG. 4 is a partial sectional side view of a closure and container in a closed position relative to one another;

FIG. 5 is a partial sectional side view and a partial side view of a closure and container in a closed position with a tear strip removed;

DESCRIPTION OF A PREFERRED EMBODIMENT

Figure 1:
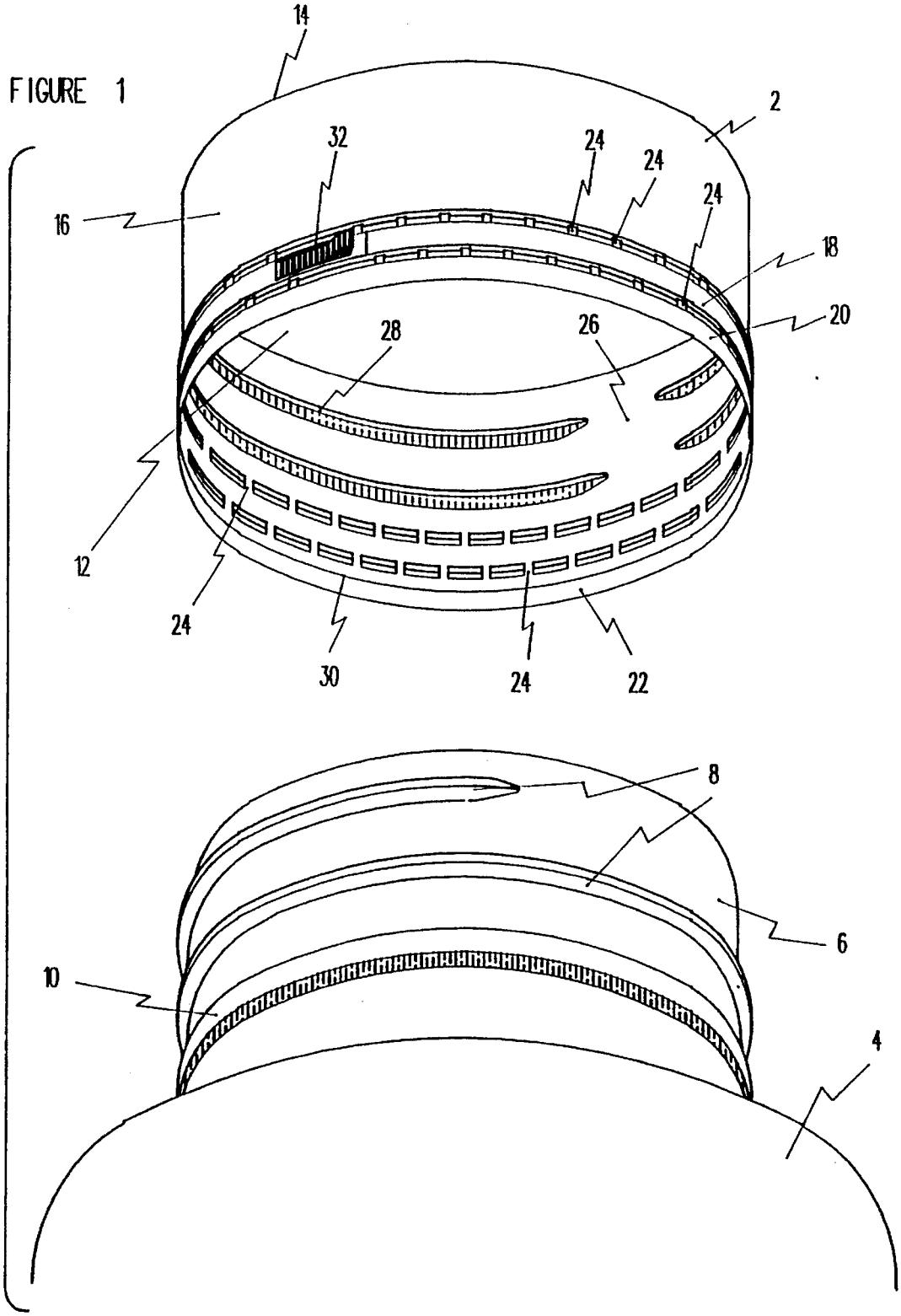
FIG. 1 is a somewhat expanded perspective view of a closure located above a partial container.
Figure 2:
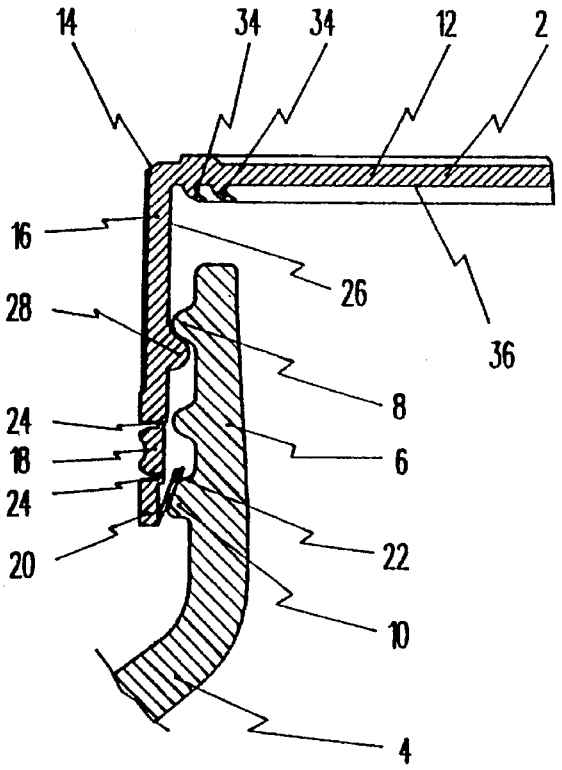
FIG. 2 is a partial sectional side view of a closure partly installed on a container.

In FIG. 1, a closure 2 is located above a container 4. The container 4 has a neck 6 with external threads 8 thereon. The neck has a ring 10 located beneath the threads 8 when the container is in an upright position as shown in said Figure. The closure 2 has a central portion 12 with a periphery 14 and a skirt 16 extending from said periphery. A tear strip 18 extends from the skirt 16 and a tamper evident band 20 extends from the tear strip 18. A movable flange 22 extends from the band 20. The tear strip 18 is affixed between the skirt 16 and the band 20 by severable attachment means, being a plurality of severable tabs 24. Alternatively, the tear strip could be affixed between the skirt and the band by a scored line of contact. The tabs 24 are preferred to a scored line. The skirt 16 has an interior surface 26 with threads 28 thereon corresponding to the threads 8 on the container. The threads 28 can be one continuous thread or several partial threads or any suitable combination in between. The flange 22 is connected to the band 20 by hinging means which is simply a scored line of contact between the flange 22 and the band 20. The flange 22 extends inwardly relative to the band 20 and a free edge 30 of the flange 20 is movable between an upper position and a lower position. The upper position is shown in FIG. 2. A tear strip 18 has two ends with one end having a handle 32. Preferably, there are no tabs 24 located to affix the handle 32 to either the skirt 16 or the band 20. It can be seen that there are two sets of tabs 24, one set interconnecting the tear strip 18 and the skirt 16 and the other set interconnecting the tear strip 18 and the band 20. Preferably, the tabs of each set are offset vertically from one another and, still more preferably, the tabs of one set are located to alternate vertically along said tear strip with the tabs of the other set. The spacing between the tear strip and the skirt and the tear strip and the band as well as the length of the tabs has been exaggerated for ease of illustration to expose the tabs.

In FIG. 2, a partial sectional side view is shown through one side of the closure and container. The other side would be a mirror image of the side shown. It can be seen that the closure 2 is partly installed on the neck 6 of the container 4. The threads 28 of the closure 2 are interlocking with the thread 8 of the container 4. The closure has been turned onto the container to a point where the flange 22 has partially overridden the ring 10. The flange 22 is forced into the upper position by said ring. Two concentric circular ridges 34 are located on an interior surface 36 of the central portion 12. The ridges 34 provide a double seal with the container 4 when the closure is in a closed position relative to said container. The ridges 34 have been omitted from the closure shown in FIG. 1 to avoid confusion. The tear strip in FIG. 2 is located very close to the skirt and to the band, the tabs being much shorter than the tabs of FIG. 1. FIG. 2 is more accurate than FIG. 1 in relation to the length of the tabs of an actual closure.

Figure 3:
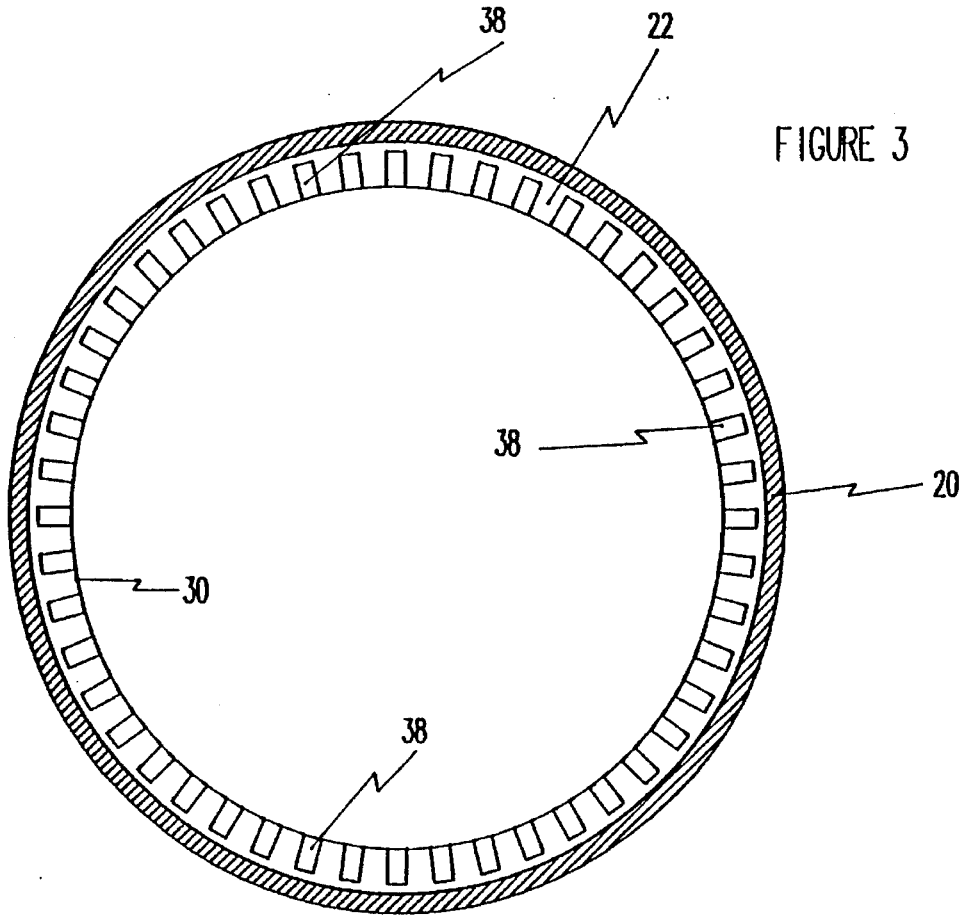
FIG. 3 is a partial sectional top view of a tamper evident band and flange.

In FIG. 3, a sectional top view through the band 20 shows the movable flange 22. The flange 22 has a plurality of lateral ribs 38 to add strength to the flange 22 so that it will not buckle and override the ring 10 when the closure is being removed from the container unless the tabs 24 are severed.

FIG. 4 is similar to FIG. 2 except that the closure 2 is in a closed position on the container 4. In this position, the flange 22 has overridden the ridge 10 and the free edge 30 of the flange 22 rests against the neck 6 beneath the ring 10. In FIG. 4, a gap between the free edge 30 and the ring 10 is exaggerated for ease of illustration. However, the closure should be designed to have a gap between the edge 30 and the ring 10 when the closure is in a closed position on the container to allow for manufacturing tolerances. If the closure is designed without such a gap and a particular closure is somewhat smaller than the design, the flange 22 will not be located beneath the ring 10 when the closure is in a closed position and the tamper resistant feature will be inoperable. Further, it can be seen that the ridges 34 are in contact with an upper surface 40 of the neck 6.

In FIG. 5, there is shown a side view of the closure 2 in a closed position on the container 4 with part of the view shown in cross-section. The tear strip 18 is not shown in FIG. 5 as it has been removed. It can be seen that when the tear strip is removed, a readily apparent gap 42 exists between the skirt 16 and the band 20 exposing part of an outer surface of the neck 6 and part of the ring 10. Once the tear strip 18 has been removed, the closure 2 can be removed from and replaced on the container in a normal fashion and will function as a conventional closure. Thus, when the tear strip is removed, it is immediately visually apparent to any potential purchaser or user of the product within the container that the product may have been tampered with. The spacing of the tear strip in FIGS. 4 and 5 is the same as that shown in FIG. 2.

From FIG. 1, it can be seen that the tabs are all of equal size and shape and are located between the skirt and tear strip and between the band and tear strip so that the tabs are flush with the interior surface of the skirt but set back from an exterior surface of the skirt. When the tabs are formed in the mold, the cavities to allow for the tabs are located in the core of the mold. The knife that advances into the space between the skirt and the strip and between the band and the strip is formed in two parts, each having a segment that abuts the core. The two segments together form a circle when the knife is fully inserted. When the two parts of the knife are withdrawn from the core, they are withdrawn in opposite directions. If the tabs were not set back from the outer surface, the removal of the knives would distort those tabs that were located near the side edges of each part of the knife. Each tab that was further removed from the side edges of the knife would be distorted to a lesser degree and the tabs closest to a centre of each part of the knife would not be distorted at all. The tabs would therefore have to be designed to be of different sizes and shapes. This might cause some of the tabs to sever prematurely during installation, shipping or handling. By setting the tabs back from the outer surface in accordance with the present invention, the tabs can all have equal size and shape and all of the tabs therefore have the same strength.

Figure 6:
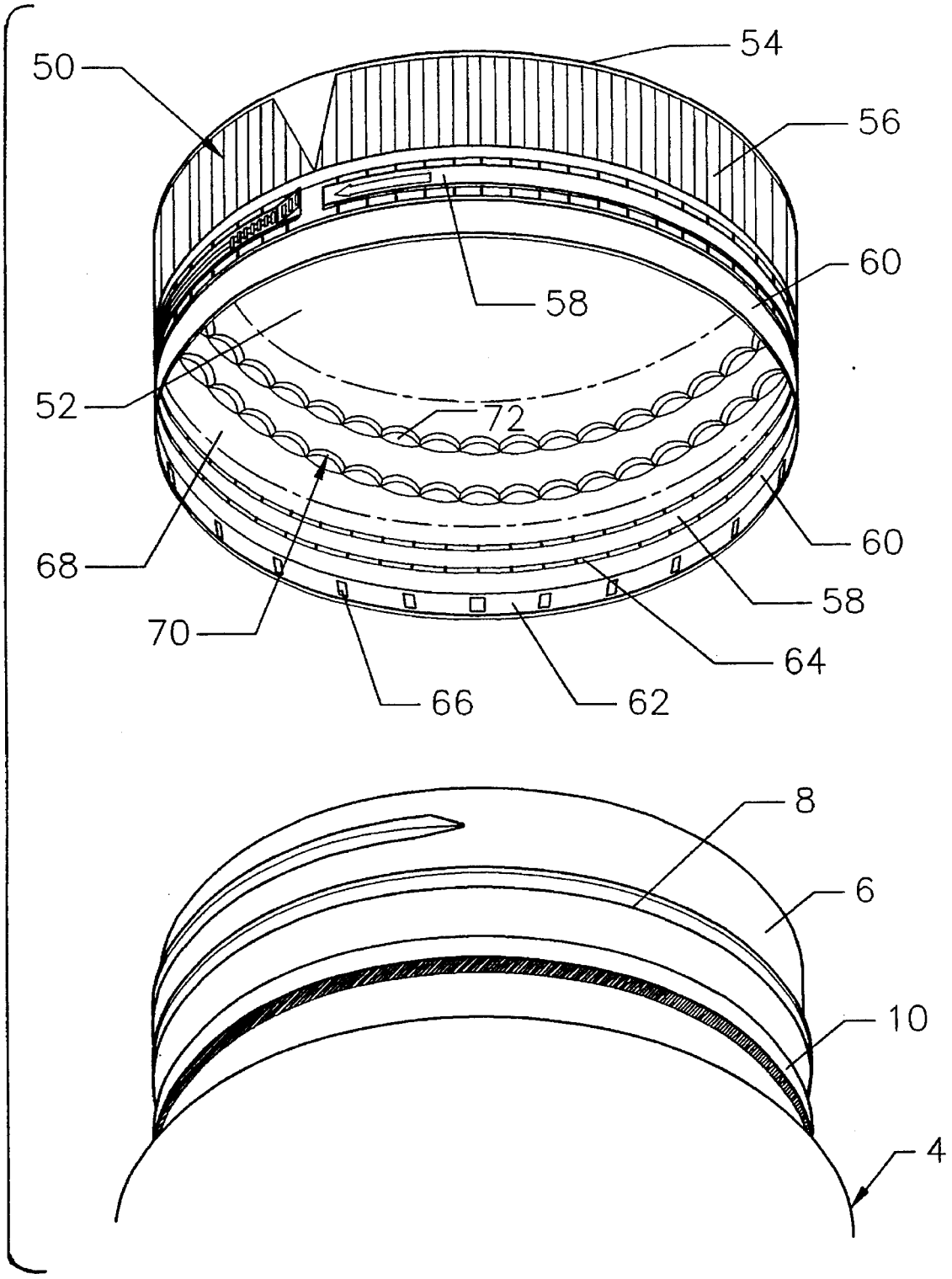
FIG. 6 is a perspective view of a further embodiment of a closure and a container where the closure has a bubbled screw thread and windows on a flange.

In FIG. 6, a closure 50 is located above a container 4. The container 4 has a neck 6 with conventional external screw threads 8 thereon. The neck 6 has a ring 10 located beneath the threads 8 when the container is in an upright position as shown in said Figure. The closure 50 has a central portion 52 with a periphery 54 and a skirt 56 extending from said periphery. A tear strip 58 extends from the skirt 56 and a tamper evident band 60 extends from the tear strip 58. A movable flange 62 extends from the band 60. The tear strip 58 is affixed between the skirt 56 and the band 60 by severable attachment means, being a plurality of severable tabs 64. On the flange 62 are a plurality of spaced windows 66. The skirt 56 has an interior surface 68 with screw threads 70 thereon. The screw threads 70 can be one continuous screw thread or can be several partial threads or any suitable combination in between. The screw threads 70 are made up of a plurality of elongated bubbles 72 that are located end to end to one another to form a screw thread. With conventional threads, when installing plastic closures on plastic containers using a capping machine, and particularly, a high speed capping machine, there is a large amount of dusting produced from the corresponding screw threads on the closure and container during installation. Dusting refers to fine particles of plastic that break free from the closure and/or the containers due to friction during installation of the closure. Dusting is still a serious problem whether the container is made of glass or plastic. Particularly when the container is used for food, the amount of dusting from conventional screw threads has been found to be unacceptable. With the elongated bubble threads 70 of the present invention, the amount of dusting that occurs is reduced by approximately 75% over conventional screw threads.

Figure 7:
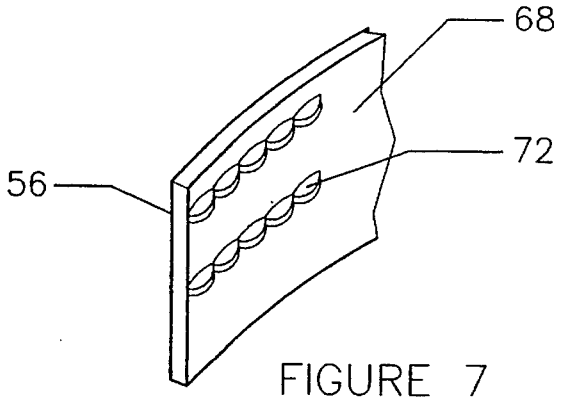
FIG. 7 is a partial perspective view of a bubbled screw thread.
Figure 8:
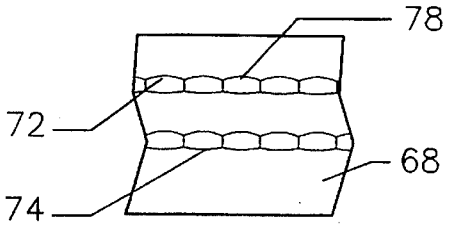
FIG. 8 is a partial front view of a bubbled screw thread.
Figure 15:
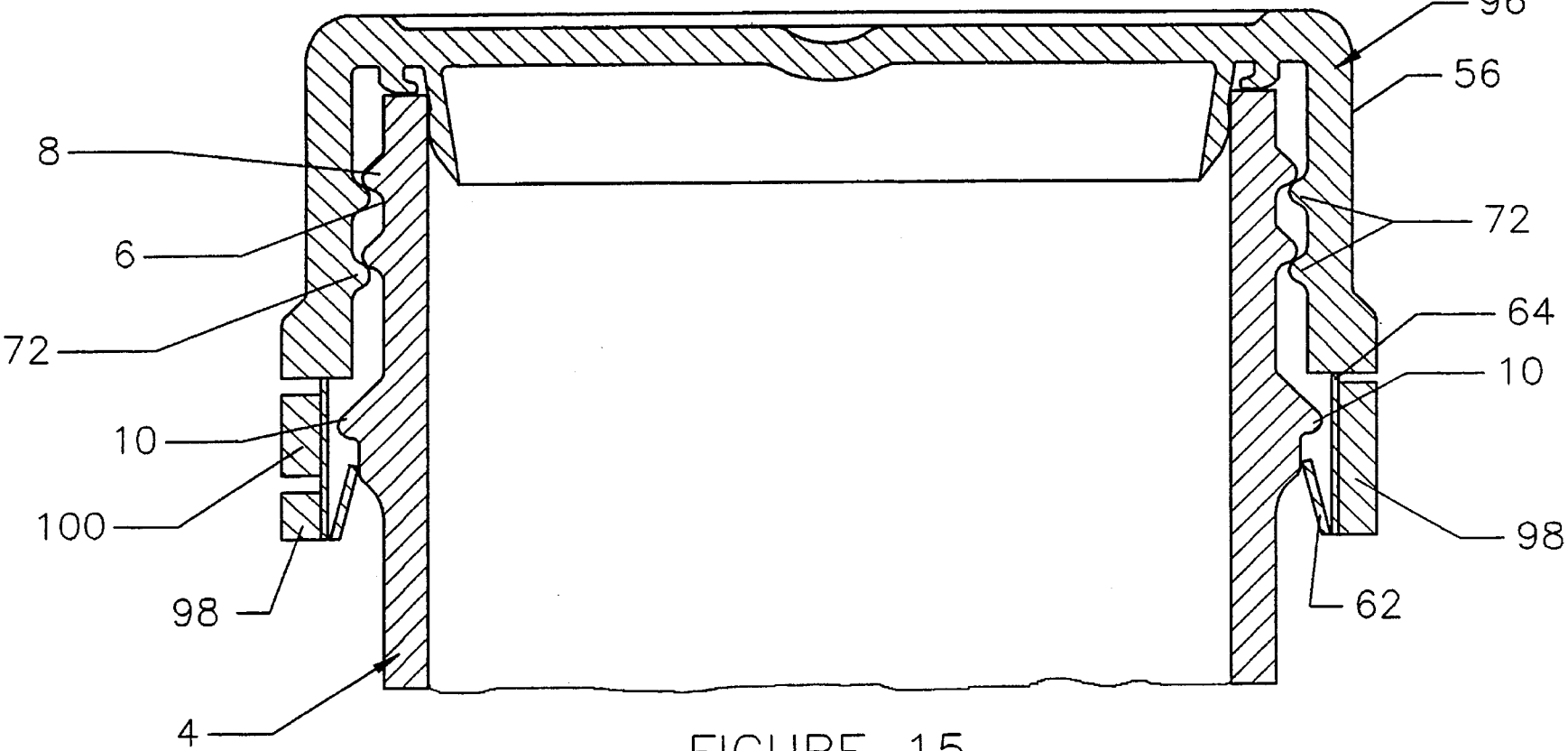
FIG. 15 is a cross-sectional view of a further embodiment of a closure and part of a container where a tear strip and tamper evident band are one component.

In FIGS. 7 and 8, the shape of the bubbles 72 can be seen more clearly. From FIG. 8 it can be seen that the bubbles 72 are relatively flat en a bottom 74 and rounded outward on a top 76. Generally, the bubbles can be described as having a curved oblong surface (the cross-section of which is shown in FIG. 15) with rounded edge. The edges are not 90° as shown in FIGS. 6 and 7.

Figure 9:
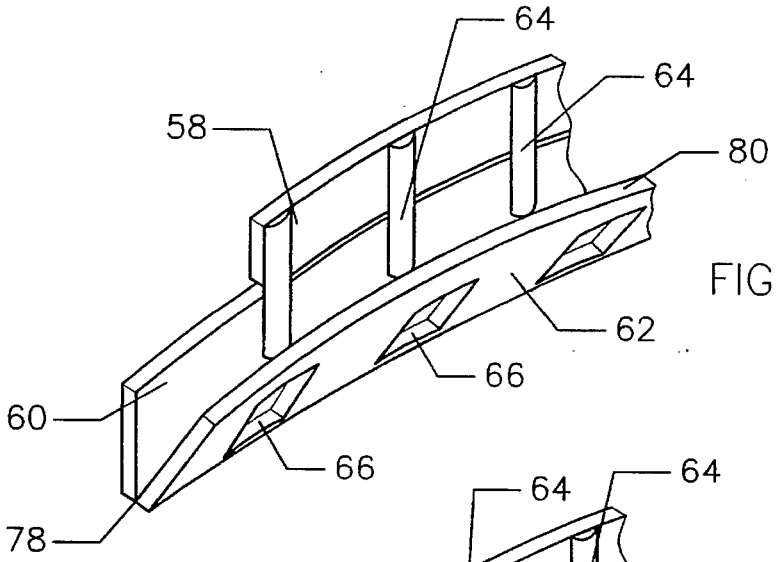
FIG. 9 is a partial perspective view of a closure with a flange extending upward.
Figure 10:
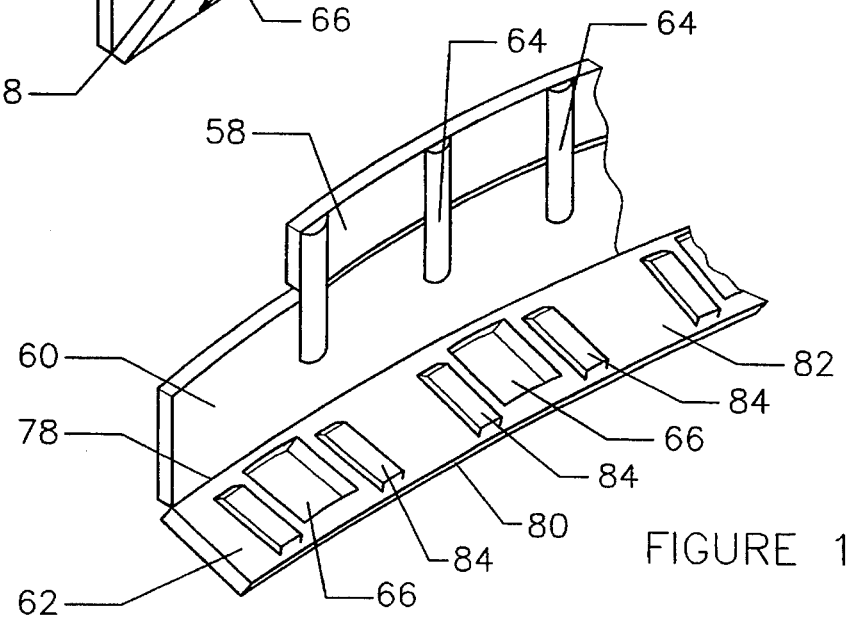
FIG. 10 is a partial perspective view of a closure with a flange extending downward.

In FIGS. 9 and 10, there is shown an enlarged partial perspective view of the flange 62 and tamper evident band 60. The flange 62 is connected to the tamper evident band 60 by hinging means 78. From FIG. 9, it can be seen that the flange 62 has a plurality of equally spaced windows 66 located therein. The windows 66 are spaced apart from the hinging means 78 and are generally substantially centrally located between the hinging means 78 and an inner edge 80 of said flange. The position of the flange 62 shown in FIG. 9 is the approximate position of the flange when it is installed beneath the ring 10 of the container 4. In FIG. 10, the flange has been moved further apart from the tamper evident band 60 to expose an interior surface 82 of said flange. It can be seen that there are two lateral ribs located between each window 66. The purpose of the lateral ridges 82 is to provide lateral strength to the flange 62 so that it will not bend laterally once it is installed on a container. If a flange were to bend laterally, it would be possible to turn the closure off a container without severing the tabs 64. The purpose of the windows 66 is to provide longitudinal flexibility to the flange 62 so that the inner edge 80 can be stretched over the ring 10 even though an inside diameter of the flange 80 when the flange is in a rest position is smaller than an outside diameter of the ring 10. Thus, it can be seen that the flange 62 can be stretched relatively easily over the ring 10. The flange 62 could be designed with only one ridge located between each window rather than two ridges. The windows can be completely open or they can be closed with a thin film of plastic or other closure material.

Figure 11:
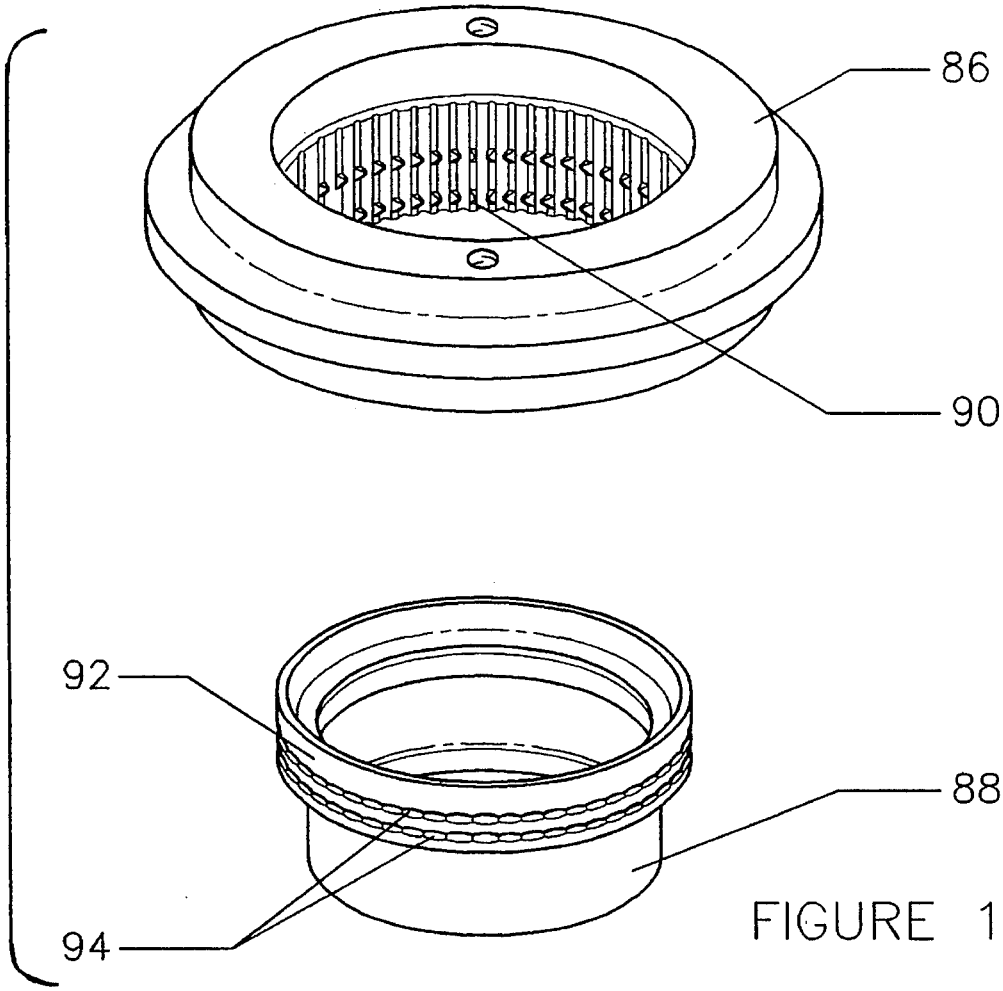
FIG. 11 is a perspective view of an electrode and core spaced apart from one another.

In FIG. 11, there is shown an electrode 86 located above a core 88. The electrode 86 has a plurality of contact points 90. The contact points 90 are located on vertical edges 91. An inside diameter of the contact points 90 is slightly larger than an outside diameter of the core 88 so that an outer surface 92 of the core 88 can fit within the electrode 86. The electrode 86 is mounted into a conventional electrical discharge machine (not shown) and a high voltage is applied to said electrode. The core 88 is mounted within the electrode 86 with the surface 92 adjacent to the contact points 90. When it is desired to create two bubble forming grooves vertically apart from one another, there are two contact points 90 located vertically apart from one another on the same vertical edge 91.

Figure 12:
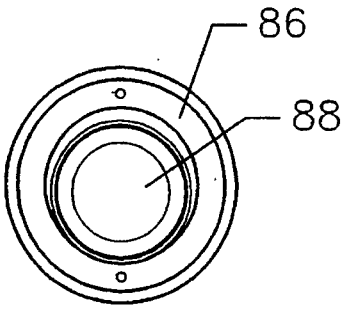
FIG. 12 is a schematic top view of an electrode and core in one position.
Figure 13:
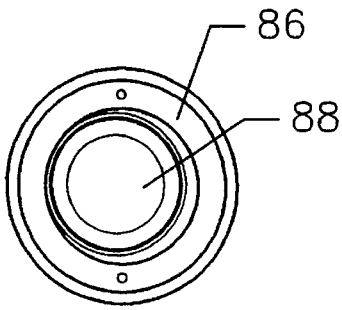
FIG. 13 is a schematic top view of the electrode and core in a different position from that shown in FIG. 12.
Figure 14:
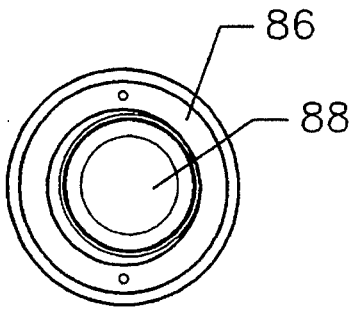
FIG. 14 is a schematic top view of the core and electrode in a different position from that shown in FIGS. 12 and 13.

As shown in FIGS. 12, 13 and 14, the electrode 86 is moved slightly relative to the core 88 so that one of the contact points 90 of the electrode 86 contacts the outer surface 92 of the core 88. In the portion of the outer surface 92 shown in FIG. 11, there are two rows of grooves 94 in the shape of inverted elongated bubbles arranged end to end to form a screw thread. As each contact point contacts the outer surface 92, one groove for one inverted elongated bubble for each row is burned into the core 88. The contact points 90 are 5° apart from one another and the electrode 86 is therefore moved 5° at a time relative to the core 88 until all of the contact points around the electrode 90 have successively contacted the outer surface 92 of the core 88. The distance of movement shown in FIGS. 12, 13 and 14 is greatly exaggerated to approximately 120° between each figure as a 5° distance would not be noticeable. Depending on the size of bubbles that one wished to create, the distance between contact points on adjacent edges could be more or less than 5°. From FIG. 11, it can be seen that the grooves 94 are relatively flat on a bottom and rounded outward on a top so that when the core is used in a mold to form the closure with the elongated bubbled screw threads, the screw threads can be removed from the core without damaging them. The core is then used in a conventional molding machine to form a closure. The closure is placed into a bending machine to rotate the flange to an inward position (as shown in FIG. 1).

In FIG. 15, in a further embodiment of the invention, a closure 96 is identical to the closure 50 shown in FIG. 6 down to the tear strip. With the closure 96, the tear strip and tamper evident band are combined into one component so that when the tear strip is pulled, the band and tear strip are removed along with the flange 62. The tear strip/band 98 has a handle 100. When the handle is pulled, tabs 64 are severed and the tear strip band 98 pulls away from the skirt 56. Preferably, though not shown in FIG. 15, approximately the last approximately 10° in circumference of the tear strip band 98 is affixed to the skirt so that an end of the band 98 opposite to the handle 100 remains affixed to the skirt to discourage a user from discarding the band 98 separately from the skirt. This feature will reduce pollution caused by discarded bands. If a user wishes to tear the band completely off the skirt, he or she will be able to do so by cutting it off or by applying an appropriate force. The sectional view of the screw thread 70 shows the cross-sectional shape to a centre of bubbles 72. It can be seen that the upper surface of each bubble 72 is rounded outward relative to the lower surface of each bubble. It can also be seen that edges of the bubble are rounded. Where the cross-sectional shape, shown in FIG. 15, differs from the shape of the bubbles 72 shown in FIGS. 6 and 7, the shape in FIG. 15 is the preferred shape. Further, the cross-sectional shape of the ring 10 and of the standard screw thread 8 of the container 4 are also shown.

The present invention has a significant advantage over previous tamper resistant closures in that the use of the hinged flange 20 allows variations in the relative size of the closure and container within acceptable tolerances. Also, the tabs 24 can be made with a great deal of strength. This strength can be increased by increasing the number or size of the tabs 24. Since the tabs 24 are severed by manually pulling the tear strip 18, the tabs 24 are severed one at a time, if the two sets of tabs are alternated or, if the two sets of tabs are vertically aligned with one another at the rate of two at a time. With previous tamper resistant closures using the hinged flange 22 and tabs or a scored line, the removal of the closure requires that all of the tabs or the entire scored line be severed virtually simultaneously. Sometimes, a great deal of strength is required to sever the tabs or the scored line. With the present invention, the tabs can be severed easily, singly or in pairs, while always providing more than sufficient strength to ensure that the tabs do not sever prematurely during the initial installation of the closure on the container or during shipping and handling. The present invention permits a broad range of design relating to the strength of the tabs.

Further, the windows permit the flange of the closure to be designed with an inside diameter significantly smaller than an outside diameter of said ring on the container. This is particularly important for large closures (for example, those having a diameter greater than 7 cm). By giving the flange greater flexibility, the windows enable the capping machine to differentiate between the torque required to turn the closure onto the container over the ring and the final torque required to tighten the closure. The torque required to turn the closure over the ring is no more than 75% of the final torque. Further, when the container is made from plastic material rather than from glass, the container will flex somewhat and it is even more important to size the closure within very close tolerances relative to the container. In addition, the bubble threads can greatly reduce dusting to acceptable levels. Bubble-shaped screw threads can also be used on the container.

What I claim as my invention is:

1. A tamper resistant closure for use on a container having a neck surrounding an opening, said neck having external threads thereon, said neck having a ring located beneath said threads when the container is in an upright position, said closure comprising a central portion having a periphery with a skirt extending from said periphery, a tear strip extending from said skirt, a tamper evident band affixed to said tear strip and a movable flange extending from said band, said tear strip being affixed to said skirt by severable attachment means, said skirt having an interior surface with threads thereon corresponding to the threads on said container, said flange being connected to said band by hinging means so that said flange extends inwardly relative to said band and a free edge of said flange is movable between an upper position and a lower position, said central portion, skirt, strip, band and flange being sized to fit snugly on said neck so that when the threads of the neck are engaged with the threads of the closure, the closure is in a closed position relative to said container and the free edge of said flange is located above said hinging means and beneath said ring, the flange overriding said ring as the closure is installed on said container, said flange engaging said ring when the closure is attempted to be removed from said container to prevent said flange from overriding said ring, said band and flange being detachable from said skirt by manually severing said attachment means to remove said tear strip.

2. A closure as claimed in claim 1 wherein said tear strip is affixed between said skirt and said band by severable attachment means, said tear strip being removable while leaving said band on said container separated from said skirt.

3. A closure as claimed in claim 1 wherein the severable attachment means are two sets of severable tabs, the tabs of one set connecting said tear strip to said skirt and the tabs of another set connecting said tear strip to said band.

4. A closure as claimed in claim 3 wherein there are a plurality of spaced windows located in said flange, said windows being spaced from said hinging means and from said free edge, said windows being substantially centrally located between said hinging-means and said free edge.

5. A closure as claimed in claim 4 wherein said windows are equally spaced from one another.

6. A closure as claimed in any one of claims 4 or 5 wherein the windows are closed by a thin layer.

7. A closure as claimed in claim 3 wherein an inside diameter of a free edge of said flange is significantly smaller than an outside diameter of said ring on said container.

8. A closure as claimed in claim 4 wherein the threads of the closure are a series of elongated bubbles, each bubble having two ends in a longitudinal direction, said bubbles being located end to end in the shape of a screw thread.

9. A closure as claimed in claim 8 wherein the bubbles are identical to one another and where parts of the screw thread of the closure are located vertically adjacent to each other, the bubbles of one part are vertically aligned with the bubbles of the adjacent part.

10. A closure as claimed in claim 8 wherein the bubbles are relatively flat on a bottom and curved outwards on a top, said top of each bubble being located closer to said central portion than said bottom and being located vertically apart from said bottom.

11. A closure as claimed in any one of claims 1, 4 or 8 wherein there are a plurality of lateral ribs located on said flange, said ribs extending between said hinging means and said free edge.

12. A closure as claimed in any one of claims 4 or 5 wherein there are a plurality of lateral ribs located on said flange, said ribs extending between said hinging means and said free edge, said ridges and windows alternating with one another, said ridges being sized to provide sufficient lateral strength to said flange so that when it is in position on said container, it will not bend laterally to override said ring, said windows providing sufficient flexibility to said flange so that it can be stretched over said ring during installation with said inner edge having and inside diameter smaller than an outside diameter of said ring.

13. A closure as claimed in claim 3 wherein the tabs of one set are vertically offset from the tabs of the other set.

14. A closure as claimed in claim 3 wherein the tabs of one set are located to alternate along said tear strip with the tabs of the other set.

15. A closure as claimed in any one of claims 1, 4 or 8 wherein the flange has a plurality of lateral ribs thereon to provide lateral strength.

16. A closure as claimed in any one of claims 1, 4 or 8 wherein the central portion has an interior surface with two concentric circular ridges located thereon near said periphery, said ridges providing a double seal with said container when said closure is in a closed position on said container.

17. A closure as claimed in any one of claims 3, 4 or 8 wherein the tabs are strong enough so that they will not sever during installation of the closure on said container but weak enough that they will sever when the tear strip is pulled manually.

18. A closure as claimed in claim 1 wherein the tear strip has a handle located at one end thereof and there are no tabs located on said handle.

19. A closure as claimed in any one of claims 3, 4 or 8 wherein the tabs are all of equal size and shape and are located between the skirt and tear strip and between the band and tear strip so that the tabs are flush with the interior surface of the skirt but set back from an exterior surface of the skirt.

20. A method of installing and removing a tamper resistant closure relative to a container, said container having a neck surrounding an opening, said neck having external threads thereon with a ring located beneath said threads when the container is in an upright position, said closure having a central portion with a periphery and a skirt extending from said periphery, a tear strip extending from said skirt, a tamper evident band extending from said tear strip and a movable flange extending from said band, said tear strip being affixed between said skirt and said band by severable attachment means, said skirt having an interior surface with threads thereon corresponding to threads on said container, said flange being connected to said band by hinging means so that said flange extends inwardly relative to said band and a free edge of said flange is movable between an upper position and a lower position, said method comprising installing said closure on said container so that said flange overrides said ring and is located beneath said ring when the closure is in a closed position relative to said container and said free edge of said flange is located above said hinging means and beneath said ring, subsequently, when it is desired to remove said closure from said container, grasping one end of said tear strip and manually pulling it to sever the attachment means and to remove the tear strip from said closure, then removing said closure from said container, the band and flange remaining on said container.

* * * * *